US006045281A

United States Patent [19]

Bunn et al.

[11] Patent Number: 6,045,281

[45] Date of Patent: Apr. 4, 2000

[54] WRITING IMPLEMENT ATTACHMENT

[75] Inventors: Renae B. Bunn, 3121 Arizona, NE., Albuquerque, N.Mex. 87110; Randy B. Krall; Karen Krall, both of Albuquerque, N. Mex.; Nathan Z. Korn, Corrales, N.Mex.

[73] Assignee: Renae B. Bunn, Albuquerque, N.Mex.

[21] Appl. No.: 08/885,339

[22] Filed: Jun. 30, 1997

[51] Int. Cl.[7] ..... B43K 29/00

[52] U.S. Cl. ..... 401/195; 401/52; 40/334

[58] Field of Search ..... 401/6, 52, 131, 401/195; 40/645, 334, 335; D19/44; 15/443

[56] References Cited

U.S. PATENT DOCUMENTS

| | | | |
|---|---|---|---|
| D. 11,795 | 6/1880 | Fairchild | D19/44 |
| D. 164,548 | 9/1951 | Blish . | |
| D. 276,479 | 11/1984 | Mori | 401/6 X |
| D. 310,101 | 8/1990 | Gauthier | 401/52 X |
| D. 338,037 | 8/1993 | Miller et al. | 401/131 X |
| 558,733 | 4/1896 | Lathrop . | |
| 1,211,356 | 1/1917 | Roetker | 40/335 |
| 1,266,639 | 5/1918 | Swan | 15/443 |
| 1,297,017 | 3/1919 | Scott | 401/52 X |
| 1,305,245 | 6/1919 | Barthelemy . | |
| 1,616,147 | 2/1927 | Smiley | 40/645 |
| 1,713,380 | 5/1929 | Green . | |
| 1,832,318 | 11/1931 | Myers . | |
| 2,248,145 | 7/1941 | Wilder | 401/52 X |
| 2,502,328 | 3/1950 | Kuhn . | |
| 2,574,615 | 11/1951 | Brewer . | |
| 2,682,123 | 6/1954 | Fredrickson . | |
| 3,846,927 | 11/1974 | Geffen . | |
| 3,961,852 | 6/1976 | Parry | 401/52 X |
| 4,217,712 | 8/1980 | Koeln . | |
| 4,243,338 | 1/1981 | Williams . | |
| 4,508,464 | 4/1985 | Money . | |
| 4,658,523 | 4/1987 | Adell . | |
| 4,678,206 | 7/1987 | Leahan . | |
| 4,728,212 | 3/1988 | Spector . | |
| 4,787,161 | 11/1988 | Feng | 401/52 X |
| 5,086,577 | 2/1992 | Abernethy . | |
| 5,207,172 | 5/1993 | Fabbrini . | |
| 5,308,179 | 5/1994 | Whitright | 401/131 |

FOREIGN PATENT DOCUMENTS

| | | | |
|---|---|---|---|
| 1345646 | 11/1963 | France | 401/6 |
| 3407335 | 8/1985 | Germany | 401/52 |
| 3639892 | 6/1988 | Germany | 401/6 |

OTHER PUBLICATIONS

"Quick Clip" attachment shown in Bic Catalog (1995), p. 39.

*Primary Examiner*—David J. Walczak
*Attorney, Agent, or Firm*—Peacock, Myers & Adams

[57] ABSTRACT

An anti-theft attachment for a writing implement, such as a pencil or pen. The preferred anti-theft attachment comprises an adhesively attached, premanufactured front and back surface disposed on the tip or side of the writing implement. Alternative embodiments comprise flexible and rigid loops. Indicia may be provided to all embodiments.

10 Claims, 2 Drawing Sheets

WRITING IMPLEMENT ATTACHMENT

BACKGROUND OF THE INVENTION

1. Field of the Invention (Technical Field)

The present invention relates to writing implement attachments and more particularly, to an apparatus which will serve to prevent purposeful or inadvertent removal. In addition, the present invention provides for advertising, display of information, personalized messages, and the like.

2. Background Art

Writing implements, such as pens and pencils, are routinely placed in public areas for repeat use by persons patronizing that area. Examples of places where this occur are retail establishments, banks, schools, restaurants, public offices, and the like. A common problem occurs when patrons or visitors to these places remove the writing implement either on purpose or by accident. This occurs on a regular and repetitive basis because most writing implements are compact and easily fit into a pocket or purse. In addition, many persons as a matter of subconscious habit, replace writing implements into their clothing or carrying cases without thinking whether that implement is their property or not since most of these implements look and feel alike. As a result, before the available supply of writing medium (e.g., ink, pencil lead, etc.) is actually depleted, the average writing implement must be replaced. In such a case, excessive expense and time are expended while the writing implements are replaced by the institution that had made the implement available in the first place.

In an attempt to prevent loss or misplacement, U.S. Pat. No. 4,217,712, entitled "Conical Pen," to Koeln, shows a conical pen. However, the Koeln device is a pen and not an attachment. As such, because of its shape and bulk, it is difficult to hold and write with. Moreover, because it is not an attachment but is instead a pen, it therefore cannot be used in conjunction with any existing writing implement. U.S. Pat. No. 4,508,464, entitled "Foldable Pen," to Money embodies a flat or triangular shaped pen device which would also make writing difficult.

The present invention can be easily attached to virtually any writing implement. It effectively prohibits inadvertent removal of such implement by providing an attachment to the implement to make it larger and more difficult to confuse with the writer's own implement. By altering the shape and configuration, conscious attention is brought to the apparatus thereby removing it from the subconscious habit of removal.

As to persons who are inclined to appropriate the writing implement on purpose, the present invention makes this a less attractive opportunity because the enhanced size and shape make the implement and apparatus difficult to conceal in pocket or purse and less advantageous to discretely use in the future.

In the preferred embodiment of the present invention, an adhesive is used as the attachment to the writing implement. U.S. Pat. No. 4,243,338, entitled "Writing Instrument and Holder Assembly," to Williams and U.S. Pat. No. 5,207,174, entitled "Pencil Emblem Combination," to Fabbrini both teach use of adhesives on or to manufacture pens. However, the instant invention is distinguishable from those references because the attachment is very large relative to the writing implement and can be adhered to virtually any writing implement without impairing its comfortable use. Moreover, the present invention comprises anti-theft characteristics because of its size and configuration. In addition, the size of the attachment of the present invention permits a personalized message to be affixed to the attachment.

Bic, a well-known pen manufacturer, makes a "Quick Clip" attachment with cord which attaches to a specially made top (a round ball) of the pen and then clips onto this ball when the user wants to hang the pen around his/her neck (see Bic 1995 catalog, page 39). The attachment may contain custom advertising along with the pen. However, the advertising space is very small, the pen could still be easily taken unless the attachment and cord is in place and around the user's neck, and the pen top must be pre-manufactured with the ball shape to correspond to the attachment.

In some embodiments of the present invention, the attachment to the writing instrument provides a medium for advertising, logos, characters, jokes, affirmations, poems, verses, quotes, calendars, information (e.g., alphabet, periodic tables, menus, etc.), blank space for personalized messages, other indicia, and the like. The following references teach advertising as an opportunity of their devices (see U.S. Pat. No. 5,086,577, entitled "Writing Instrument Advertising Device," to Abernathy; U.S. Pat. No. 4,217,712, entitled "Conical Pen," to Koeln; U.S. Pat. No. Des. 164, 548, entitled "Advertising Magnetic Pencil Holder," to Blish; U.S. Pat. No. 2,574,615, entitled "Advertising Device for Pencils or the Like," to Brewer; U.S. Pat. No. 5,207,174, entitled "Pencil Emblem Combination," to Fabbrini; U.S. Pat. No. 3,846,927, entitled "Display Writing Instrument," to Geffen; U.S. Pat. No. 2,502,328, entitled "Display Casing for Pencils," to Kuhn; U.S. Pat. No. 558,733, entitled "Toy Cotton Boll," to Lathrop; U.S. Pat. No. 4,508,464, entitled "Foldable Pen," to Money; U.S. Pat. No. 1,832,318, entitled "Display Tag," to Myers; U.S. Pat. No. 2,248,145, entitled "Tag," to Wilder; and Bic ("Quick Clip" attachment). However, none of these offer the benefits of: large areas available for copy or personalized messages; simple attachments which can be affixed to virtually any writing implement; very inexpensive means to create an advertising modality; and anti-theft characteristics.

In other embodiments of the present invention, the attachment may serve as an area for display of logos, ornaments or other decoration. The following U.S. Patents also provide for ornamental, decorative, or collectible attachments to pens and pencils, as follows: U.S. Pat. No. 4,658,523, entitled "Collectible," to Adell (helmet); U.S. Pat. No. 1,305,245, entitled "Device for Displaying Photographs or the Like," to Barthelemy (photo mounting); U.S. Pat. No. 5,086,577, entitled "Writing Instrument Advertising Device," to Abernathy (advertising); U.S. Pat. No. 2,574, 615, entitled "Advertising Device for Pencils or the Like," to Brewer (paste); U.S. Pat. No. 5,207,174, entitled "Pencil Emblem Combination," to Fabbrini (pennant); U.S. Pat. No. 4,787,161, entitled "Advertising Writing Instrument," to Feng (flag and duck); U.S. Pat. No. 1,713,380, entitled Pen and Pencil Holder," to Green (butterfly); U.S. Pat. No. 2,502,328, entitled "Display Casing for Pencils," to Kuhn (opaque bubble); U.S. Pat. No. 558,733, entitled "Toy Cotton Boll," to Lathrop (cotton ball); U.S. Pat. No. 4,728, 212, entitled "Novelty Writing Pen," to Spector (banana, fruit, sausage); and U.S. Pat. No. 4,243,338, entitled "Writing Instrument and Holder Assembly," to Williams (beverage bottle). However, none of these devices provide large areas for logos, advertising, or personalized messages. In addition, none of these devices provide anti-theft features.

The following patents show caps on the tip or uses of pens and thus cannot be used for writing with such attachments or uses: U.S. Pat. No. 3,846,927, entitled "Display Writing Instrument," to Geffen (attachment that fits onto the cap of a pen); U.S. Pat. No. 4,678,206, entitled "Pen and Note Pad," to Leahan (flower attachment to a pen); and U.S. Pat. No. 2,682,123, entitled "Ornamental Dialer Crown," to Fredrickson (attachment to top of pen to assist in dialing a rotary phone).

SUMMARY OF THE INVENTION (DISCLOSURE OF THE INVENTION)

The present invention relates to an anti-theft attachment for a writing implement. The preferred embodiment has a front and back surface which attaches to the writing implement. Alternative embodiments comprise loops. The attachment comprises at least one dimension (e.g., diameter, length, width, or leg), which is at least one-half (and up to two to three times) the longitudinal length of the writing implement. The attachment is disposed on the writing implement at the non-writing tip (or cap) or side.

The attachment may comprise indicia on the back surface, the front surface, or inside the loop. Examples of indicia include advertising, logo, character, joke, affirmation, poem, rhyme, verse, quote, calendar, information, table, chart, valentine, slogan, saying, graphics, artwork, message, ornament, alphabet, name, number, address, periodic table, menu, recipe, schedule, directions, map, and the like. In addition, in some embodiments, the user may write additional information or add artwork, and the like, to the attachment.

In the preferred embodiment, the back surface is adhesively affixed to the front surface. Either the front surface, the back surface, or both further comprise an adhesive. Preferably, either the back surface or the front surface comprises a channel or ridge in which the writing implement is disposed.

In the alternative loop embodiments, the loop may be wholly or partially open, or may contain a planar surface inside the loop connecting portions of the loop. The loop may be attached to the writing implement, via various means, such as using wire, tape, slot, cap, or slit. The loop may be flexible or rigid.

An alternative embodiment of the invention comprises an attachment or a combination writing implement/attachment with a distinctive shape, such as a geometric shape, heart, character, sun, moon, balloon, flower, animal, logo, star, letter, number, and the like.

A primary object of the present invention is to provide an inexpensive and easily attachable device to a writing implement to prevent theft.

It is another object of the present invention to provide a means for advertising or providing information to the anti-theft attachment.

A primary advantage of the present invention is that it is does not impede writing, while providing anti-theft protection.

Another advantage of the present invention is that it can provide advertising or other information.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Best Modes for Carrying Out the Invention

The present invention relates to an anti-theft attachment to a writing implement. In all embodiments of the invention, the anti-theft characteristic is due to the largeness of the attachment, relative to the writing implement. This prevents the user from purposefully or inadvertently removing the writing implement from an area or other user.

The Figures show attachments which have a dimension of at least one half the longitudinal length (from writing tip to the non-writing tip) of the writing implement, but the dimension can be greater, e.g., three-quarters, the same, or up to two or three times the length of the writing implement. The term "dimension," as used throughout the specification and claims, is intended to mean the longest length, width, diameter (e.g., for circular shapes), or leg (e.g., for triangular shapes), including for irregular shapes.

Figure 1:
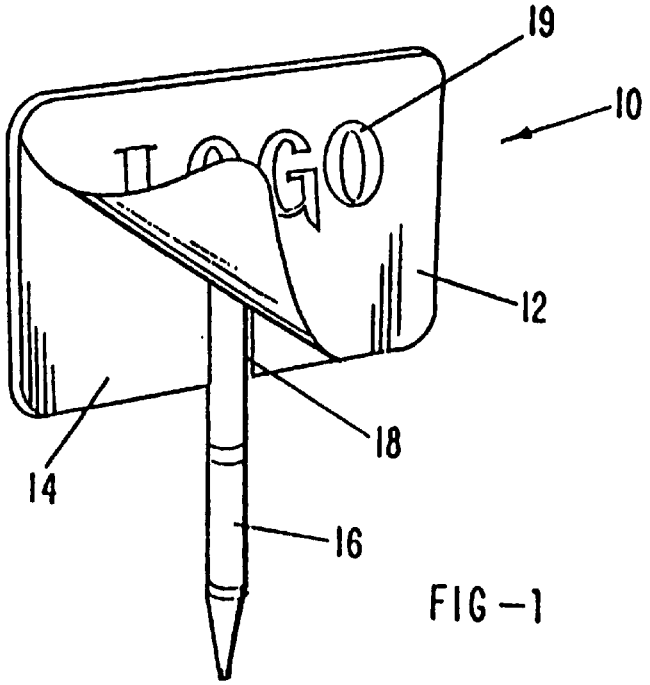
FIG. 1 is a perspective peel-away view of the preferred embodiment of the present invention, showing two surfaces adhesively attached to the writing implement.

FIG. 1 illustrates the preferred embodiment of the present invention. Attachment 10 comprises a front surface 12 and back surface 14. Both front surface 12 and back surface 14 are premanufactured, that is they are pre-cut and pre-printed, so that the user can easily attach surfaces 12 and 14 to writing implement 16.

Preferably, either front surface 12 or back surface 14 comprises a premanufactured channel or ridge 18, preferably in the shape of writing implement 16, so that writing implement 16 is easily disposed between front surface 12 and back surface 14. Channel 18 may be centered, as shown in FIG. 1, so that attachment 10 is disposed at the top and center, or may be offset to one side so that attachment 10 is disposed on the side (not shown) of writing implement 16. Attachment 10 should be of a shape, size and disposed on writing implement 16, to prevent theft, but not impede writing.

The preferred manufacturing material for the FIG. 1 embodiment is adhesively backed paper, which is inexpensive and easy to print and cut. For manufacturing, the surfaces 12, 14 may be joined together (e.g., at the top or side) and then folded during installation on the writing implement; or they may be separate pieces. Either front surface 12 or back surface 14, or both surfaces, may comprise an adhesive. However, other manufacturing materials, such as plastic, cardboard, metal, and the like may be utilized in the present invention. Likewise, the "surfaces" may be of a three-dimensional object; hence, the terms "front surface" and "back surface" incorporate all such concepts.

The term "writing implement," as used throughout the specification and claims, is intended to include pens, pencils, markers, crayons, paintbrushes, pointers, and the like. Likewise, the terms "write" and "writing" are intended to include all such uses.

Attachment 10 may be in numerous shapes, such as geometric shapes (e.g., rectangle, circle, square, oval, triangle, etc.), or irregular shapes (e.g., a famous character such as Mickey Mouse, heart, sun, moon, balloon, etc.). Attachment may be planar, such as shown in the drawings, or three-dimensional (e.g., balloon shape) and the terms "surface" and planar surface are intended to include all such embodiments. The invention is not limited to any particular shape.

Indicia 19 may be present on attachment 10, such as on front surface 12 or back surface 14. Indicia 19 may be disposed on the surface during the premanufacturing phase, or the user may "write" indicia (e.g., see indicia 34 in FIG. 3) on the surface. The term "indicia," as used throughout the specification and claims, is intended to include advertising, logos, characters (e.g., famous characters such as Mickey Mouse), jokes, affirmations, poems, rhymes, verses, quotes, calendars, information, tables, charts, valentines, slogans, sayings, graphics, artwork, messages, an ornament, alphabet, name, number, address, periodic table, menu, recipe, schedule, directions, map, etc. Indicia may serve the purpose of advertising or providing information or graphics. The variations are numerous.

Figure 2:
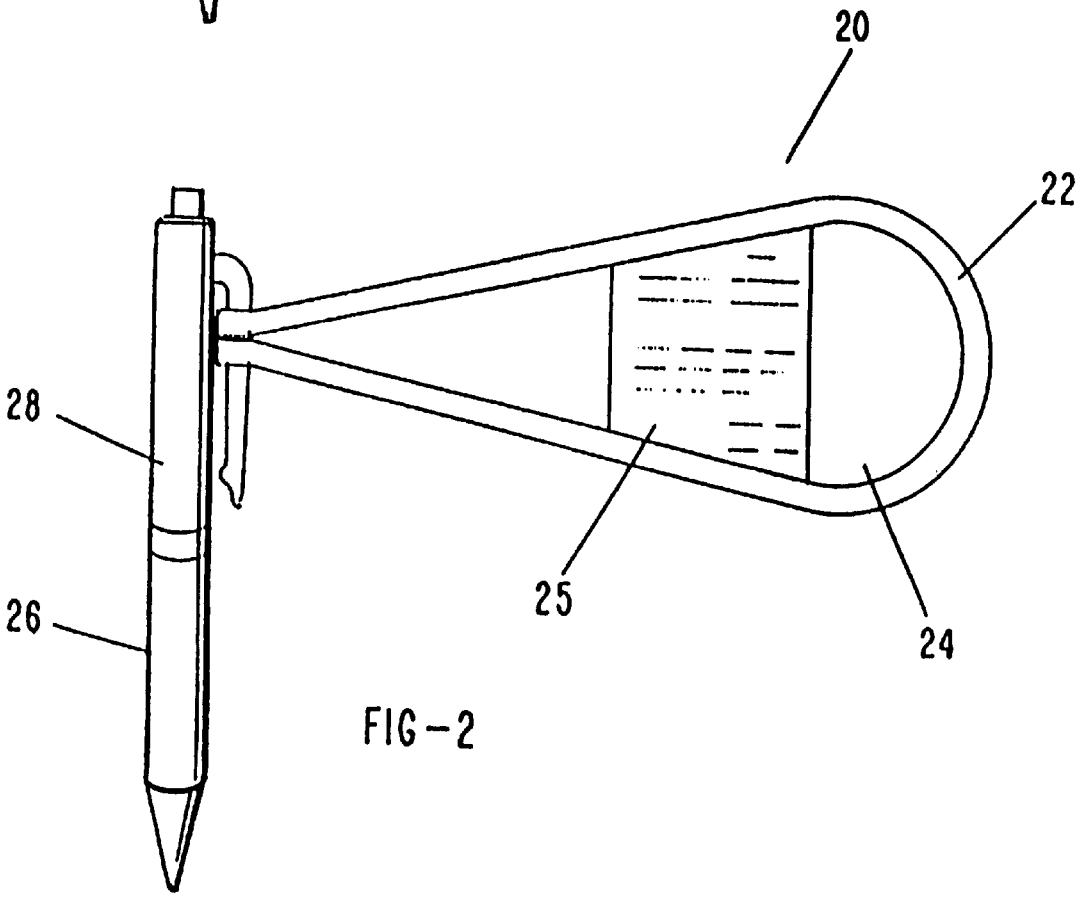
FIG. 2 is a perspective view of an alternative embodiment of the present invention, showing a flexible loop attached to the writing implement.

FIG. 2 illustrates an alternative attachment 20 of the present invention, comprising a flexible loop 22 which is disposed on writing implement 26. Loop 22 may comprise an opening therein 24, so that loop 22 "flops" easily when writing implement 26 is being used.

Alternatively, a portion or all of loop 22 may have a planar surface 25 (also see FIG. 3 and the description of the web in FIG. 3 which is fully applicable to FIG. 2) which is disposed within loop 22. Such planar surface would tend to make loop 22 less flexible. Indicia may be present on planar surface 25 or the user may write on planar surface 25.

The preferred materials for flexible loop 22 comprise plastic, rubber, rubber-like, and the like. Loop 22 should be flexible enough to prevent theft, but rigid enough so that it is not limp (e.g., string), so that attachment 20 is disposed outwardly from writing implement 26. The term "flexible," as used throughout the specification and claims, is intended to embody this above-described flexibility.

Attachment 20 is disposed on writing implement 16 via various means, such as a slot, cap, slit, wire, tape, and the like. FIG. 2 shows attachment 20 attached to a cap 28 of writing implement 26. However, it could be disposed on another part of writing implement (e.g., top or side), as long as it does not impede with writing.

Figure 3:
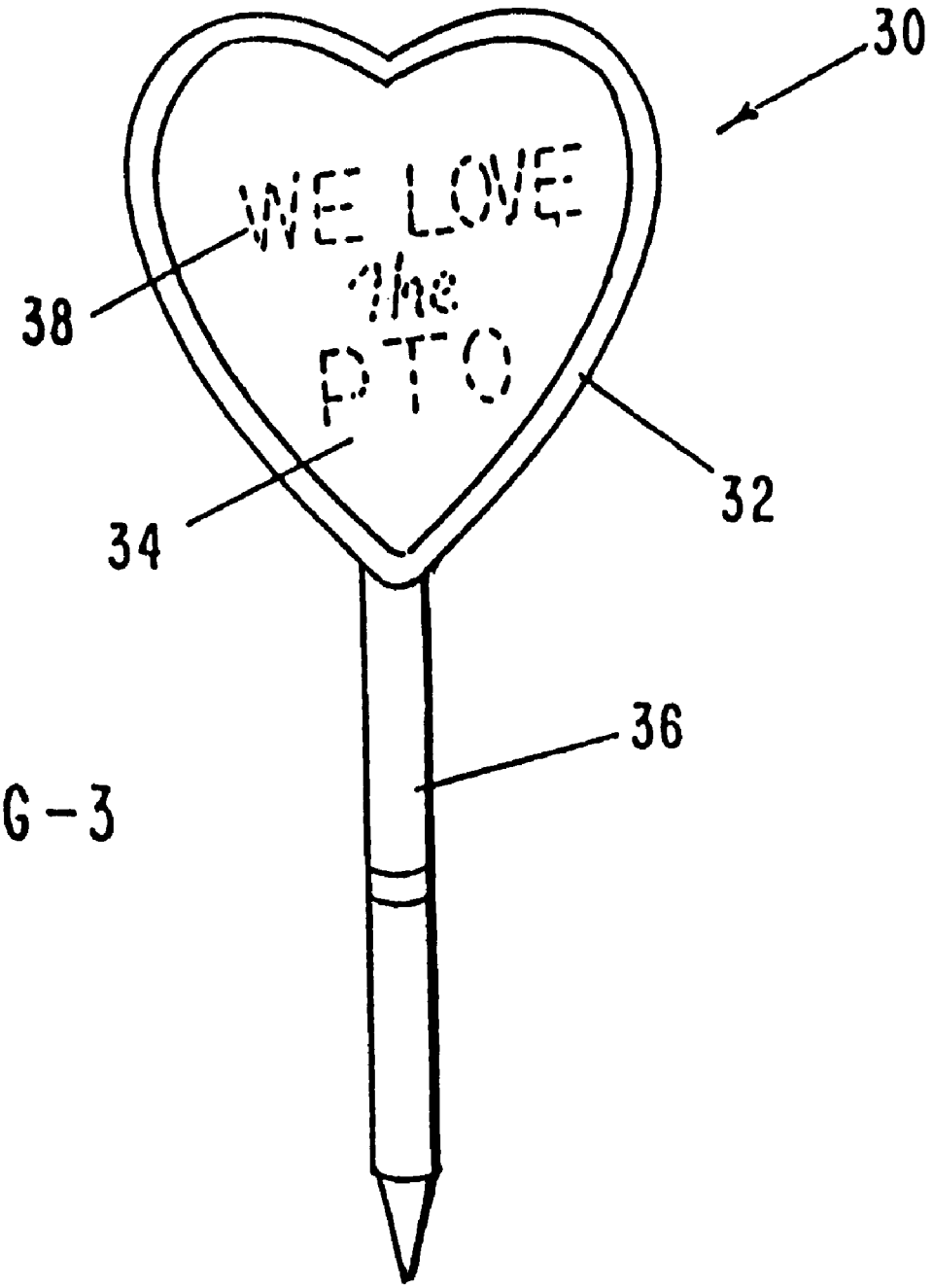
FIG. 3 is a perspective view of another alternative embodiment of the present invention, showing a rigid loop attached to the writing implement.

FIG. 3 shows another attachment embodiment 30 of the present invention, comprising rigid loop 32. The term "rigid," as used throughout the specification and claims is intended to include very rigid materials (e.g., wire and metal), and semi-rigid materials (e.g., hard plastic, rubber or rubber-like materials.

Planar surface 33 may be disposed between loop 32, in the entire loop or only in a portion (not shown). Planar surface 34 may be planar, several surfaces (such as in the FIG. 1 embodiment) or three-dimensional (not shown), depending on the shape desired. Indicia 36 may be disposed on web 34, or the user may write on planar surface 34.

INDUSTRIAL APPLICABILITY

The invention is further illustrated by the following non-limiting example, which tested several embodiments of the invention. Several flexible loops (different sizes, ranging from approximately one half the length of the pen to three times the length of the pen), made of straws (flexible plastic), were attached via tape to pens and placed within an environment in which pens were previously frequently taken. It was found that the attachment significantly reduced inadvertent or purposeful taking of the pens.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents.

What is claimed is:

1. A premanufactured accessory for a premanufactured writing implement, the premanufactured writing implement comprising at least one member selected from the group consisting of a complete pen having a casing handle, an ink supply and an ink-providing tip, and a complete pencil having a lead and a handle casing around the lead, the premanufactured writing implement having a longitudinal length, said premanufactured accessory comprising:

a premanufactured body comprising a substantially two-dimensional surface;

said surface comprising at least one dimension selected from the group consisting of a diameter, a length, and a width, said dimension being at least one-half the longitudinal length of the premanufactured writing implement; and an attachment for attaching said premanufactured body to the premanufactured writing implement on the upper portion of the premanufactured writing implement.

2. The premanufactured accessory of claim 1 wherein said attachment comprises an adhesive.

3. The premanufactured accessory of claim 2 wherein said premanufactured body comprises a back surface and a front surface and an adhesive for adhesively disposing a non-writing portion of the premanufactured writing implement between said front surface and said back surface.

4. The premanufactured accessory of claim 1 wherein said surface dimension is at least equal to the length of the longitudinal length of the premanufactured writing implement.

5. The premanufactured accessory of claim 1 wherein said surface dimension is at least equal to three quarters the length of the premanufactured writing implement.

6. The premanufactured accessory of claim 1 further comprising indicia on said surface.

7. The premanufactured accessory of claim 6 wherein said indicia comprises at least one form selected from the group consisting of a joke, affirmation, poem, rhyme, valentine, alphabet, periodic table, menu, recipe, schedule, directions, and map.

8. The premanufactured accessory of claim 1 wherein said attachment attaches said premanufactured body to an upper portion of the premanufactured writing implement in an area selected from the group consisting of a top and a side of the premanufactured writing implement.

9. The premanufactured accessory of claim 1 wherein said premanufactured body further comprises a channel in which the premanufactured writing implement is disposed.

10. The premanufactured accessory of claim 1 further wherein said attachment comprises at least one member selected from the group consisting of a wire, tape, slot, cap, and slit.

* * * * *